US005649885A

United States Patent [19]

Liljenquist et al.

[11] Patent Number: 5,649,885

[45] Date of Patent: Jul. 22, 1997

[54] MOVABLE/STORABLE EXERCISE APPARATUS

[76] Inventors: Scott Liljenquist, 9827 Tiger Eye Dr., Sandy, Utah 84094; Nate Brimhall, 6554 Bouchelle La., Salt Lake City, Utah 84121

[21] Appl. No.: 543,380

[22] Filed: Oct. 16, 1995

[51] Int. Cl.[6] ..... A63B 21/00

[52] U.S. Cl. ..... 482/95; 482/57; 482/96

[58] Field of Search ..... 482/77, 95, 57, 482/96, 104, 90, 138, 83, 130

[56] References Cited

U.S. PATENT DOCUMENTS

| | | | |
|---|---|---|---|
| 4,477,074 | 10/1984 | Bushnell | 482/104 |
| 4,491,316 | 1/1985 | Prine | 482/90 |
| 4,673,178 | 6/1987 | Dwight | 482/57 |
| 4,792,135 | 12/1988 | Chin-Sen | 482/138 |
| 4,936,573 | 6/1990 | Miller | 482/72 |
| 5,299,997 | 4/1994 | Chen | 482/72 |
| 5,480,365 | 1/1996 | Lundin et al. | 482/57 |
| 5,520,599 | 5/1996 | Chen | 482/72 |
| 5,569,130 | 10/1996 | Wang et al. | 482/72 |

*Primary Examiner*—Jerome Donnelly
*Attorney, Agent, or Firm*—Thorpe, North & Western

[57] ABSTRACT

Exercise equipment modified to provide improved mobility and convenient upright storage positioning. The exercise equipment has a restraint to immobilize a movable upper portion of the equipment relative to a stationary base component such that the equipment can be safely oriented in an upright position without sudden movement of the upper portion of the equipment. To facilitate grasping the apparatus, a new receptacle is created for the handlebar at the rear of the equipment such that the handlebar is detached from its in-use receptacle and mounted in a new receptacle parallel to the long axis. This new handlebar orientation also reduces the width of the apparatus, thus making it easier to move through doorways, and making it taller rather than wider when tipped forward to an upright position. Wheels are mounted on a bar parallel to the floor and perpendicular to the long axis of the apparatus. The wheels do not touch the ground unless the apparatus is tipped forward to an upright position. Finally, adjustable length feet mounted on the front of the apparatus but separate from the wheels form a stable surface on which the apparatus may balance.

16 Claims, 6 Drawing Sheets

MOVABLE/STORABLE EXERCISE APPARATUS

BACKGROUND OF THE INVENTION

1. Field of the Invention

This invention pertains to an exercise apparatus. More particularly, this invention pertains to exercise apparatus on which a user sits while exercising. The present invention enables the apparatus to be easily moved to a more convenient storage site and then stored in a stable upright position.

2. Prior Art

The popularity of innovative exercise equipment has resulted in significant sales of machines which enable a user to exercise in the privacy and convenience of a home. The convenience of private exercise, however, is often offset by the inconvenient size of these machines and the large amount of space which they typically occupy when stored. A significant amount of space must also be provided around the machines so that they do not strike walls, furniture, etc. when they are in use. An owner must then either dedicate space permanently to the machine and be satisfied with walking around it, or attempt to drag it against a wall or inside a storage space to keep it out of the way when not in use.

The specific type of exercise equipment which is the concern of this invention is equipment with a seat, handlebars for stability and leverage, and a platform for maintaining the equipment in a stable and upright position. The nature of this equipment is also such that it is long compared to its width and has components which extend outward from the equipment which are necessary for its use and which make it stable. The result of the physical configuration is that the equipment is difficult to move, even if there is sufficient storage space available. Further complicating the storage and transportation situation is that the machines are typically made of steel, making them heavy and difficult to drag. The equipment is also not of a type suited to rapid or complete disassembly. Thus, when a person wishes to exercise in the privacy of a bedroom, the typically limited amount of space available can rarely be set aside conveniently for exercise equipment.

Therefore, it would be an advantage over the prior art to be able to easily move the exercise equipment before and after use. It would also be an advantage if after the exercise equipment is moved, it could then be conveniently stored such that it did not require all the space typically occupied when ready for use. A further improvement would be a method and mechanism for immobilizing the exercise equipment such that it is safe to be moved to an upright position.

OBJECTS AND SUMMARY OF THE INVENTION

It is an object of the present invention to provide attachments which are conveniently fixed to exercise equipment such that the equipment is mobile.

It is another object of this invention to provide attachments such that, if the exercise equipment is partially disassembled, the disassembled part can be reattached in a different position for storage to thereby make the machine easier to move.

It is still another object of the present invention to provide attachments which allow the exercise equipment to be easily grasped by a person to make transporting the equipment more convenient.

It is yet another object of the present invention to provide attachments which enable the exercise equipment to be stored in a more convenient and compact configuration.

It is a further object of the invention to provide attachments which enable the exercise equipment to be stored in a stable and upright position suitable for storage such as is necessary to place the equipment in a closet.

Yet a further object of the invention is to provide attachments which immobilize movable components of the exercise equipment so that the equipment is stable when oriented in an upright position.

These and other objects are realized in exercise equipment modified to provide improved mobility and convenient upright storage positioning. In a preferred embodiment, the exercise equipment has a restraint to immobilize a movable upper portion of the equipment relative to a stationary base component such that the equipment can be safely oriented in an upright position without sudden and potentially dangerous movement of the upper portion of the equipment. To facilitate grasping the apparatus, a new receptacle is created for the handlebar at the rear of the equipment such that the handlebar is detached from its in-use receptacle and mounted in a new receptacle parallel to the long axis. This new handlebar orientation also reduces the width of the apparatus, thus making it easier to move through doorways, and making it taller rather than wider when tipped forward to an upright position. Wheels are mounted on a bar parallel to the floor and perpendicular to the long axis of the apparatus. The wheels do not touch the ground unless the apparatus is tipped forward to an upright position. Finally, adjustable length feet mounted on the front of the apparatus but separate from the wheels form a stable surface with the wheels on which the apparatus may balance in a tipped forward position.

In an alternate embodiment, any aerobic exercise equipment of a configuration similar to that described in the preferred embodiment is modified so as to be able to be tipped forward or backward, roll on wheels to a desired storage location, and then tipped forward so as to remain in an upright position.

Even more broadly, the present invention can be adapted to a variety of exercise equipment such as stair steppers, stair climbers and stationary bicycles which have the characteristics of having a longer long axis relative to width, a removable handlebar which is reoriented parallel to the long axis so as to create a convenient grasping surface, wheels on a base which only touch the floor when tipped forward or backward, and a restraining device to generally immobilize moveable components of the exercise equipment so that it is safe to move to a tipped forward or rearward upright position.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
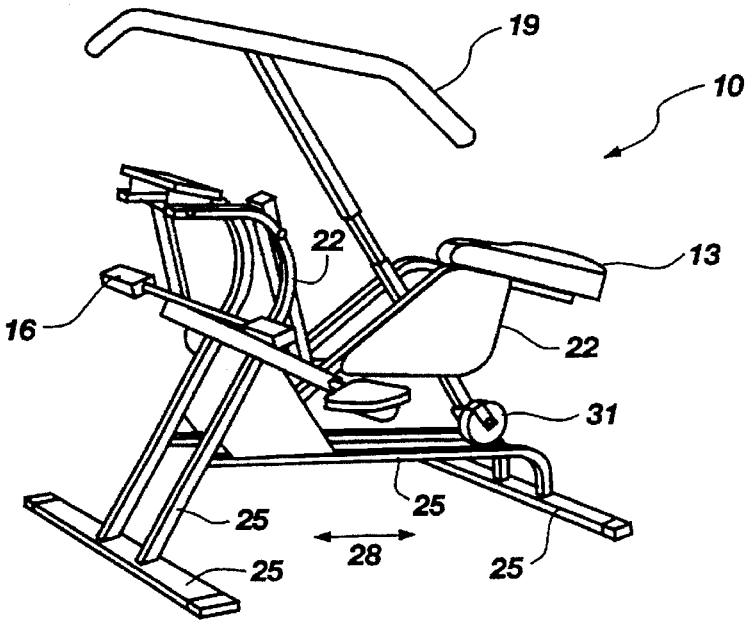
Fig. 1 (PRIOR ART)
FIG. 1 is a perspective view of an exercise apparatus before modification by the present invention.
Figure 2:
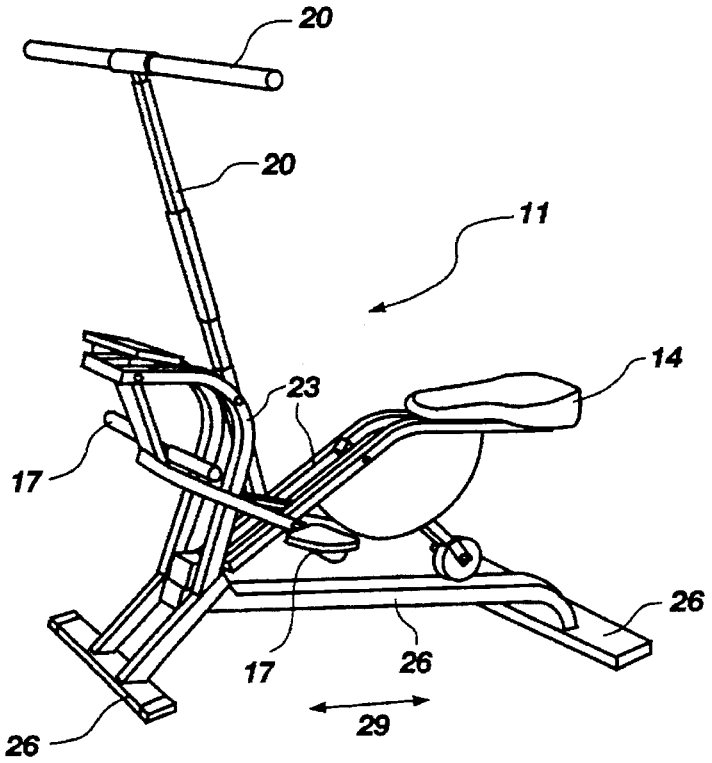
Fig. 2 (PRIOR ART)
FIG. 2 is a perspective view of another exercise apparatus before modification by the present invention.
Figure 3:
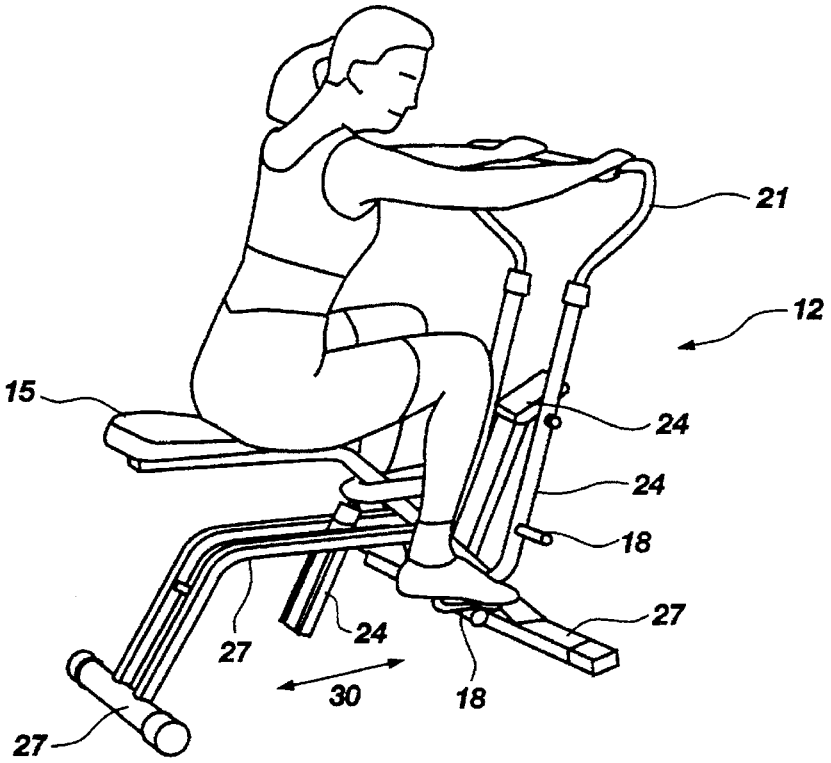
Fig. 3 (PRIOR ART)
FIG. 3 is a perspective view of another exercise apparatus before modification by the present invention.

The present invention is not a new exercise machine, but rather a combination of modifications to existing exercise equipment which make it more convenient to use any of the numerous varieties of exercise equipment currently on sale. The exercise equipment is generally referred to as repetitive motion aerobic exercise machines. FIGS. 1, 2 and 3 are provided to illustrate the preferred embodiments of the type of exercise equipment which falls within the scope of this invention. The illustrations further provide helpful background information so as to better understand how the present invention is adaptable to other forms of repetitive motion aerobic exercise machines to also be described in the claims appended hereto.

FIG. 1 is a perspective illustration of popular exercise equipment 10 which is sold on the market as a no-impact, repetitive motion exercise machine. FIGS. 2 and 3 are also provided to show the general configuration of similarly functioning exercise equipment, 11 and 12 respectively, which are within the scope of the present invention. As shown, there are several features common to all of the machines in FIGS. 1, 2 and 3. Specifically and respectively, the machines 10, 11 and 12 each have a set of movable components which include a seat 13, 14 and 15, a foot brace 16, 17 and 18, and a handlebar 19, 20 and 21. This set of components are, of course, coupled to each other in a variety of ways. The important feature is that they all are permitted to move in a limited and repetitive range of motion by pivoting upon a frame 22, 23 and 24 mounted to a stationary base 25, 26 and 27. The motion is coordinated to provide resistance to the motion such that the user must expend varying degrees of effort to move in a predefined range of motion which is repeated to provide an aerobic workout for the user.

While each of the machines 10, 11 and 12 is configured differently from each other to varying degrees, they all provide essentially the same type and range of repetitive motion for the user. The machines generally vary the most in the degree of resistance offered by the machine as the user attempts to repeat the motion over a short period of time. There are also variations in how the set of components move with respect to each other. However, it is not so important to understand the exact mechanics of the range of motion provided by the set of components as defined above. Rather, it is important to understand that the set of components are coupled to each other such that they move in a rotationally and pivotally limited range with the assistance of a frame. The frame 22, 23 and 24 acts not only to keep the set of components aligned with respect to each other, but also to couple them to the stationary base 25, 26 and 27. The stationary base 25, 26 and 27 provides support to the exercise machine 10, 11 and 12 so that it is stable when in use.

The FIGS. 1, 2 and 3 also generally establish the common feature that all of the exercise machines 10, 11 and 12 have a generally longer long axis 28, 29 and 30 and are generally narrow in width. The widest component of the machines 10, 11 and 12 is generally the handlebar 19, 20 and 21. The machines 10, 11 and 12 also generally appear to be low to the ground when not in use, except for the extension of the handlebar 19, 20 and 21 away from the frame 22, 23 and 24. These common features provide the basis for the improvements to exercise machines as defined by the present invention. The improvements enable an exercise machine as described above to be tipped forward or backward about 90 degrees so that the longer long axis 28, 29 and 30 is now generally perpendicular to the ground.

To understand the purpose of the modifications in the preferred embodiment, it is first necessary to understand a little about how the exercise equipment 10 of FIG. 1 operates. A user sitting on the seat 13 places both feet on the foot brace 16 and grasps the handlebar 19 with both hands. The user simultaneously pushes on the foot brace 16 and pulls the handlebar 19 toward the user. The forces exerted by the user causes the user to move to more of a standing position. The wheel 31 which supports the seat 13 and handlebar 19 moves forward and the seat 13 rises relative to the stationary base 25.

Figure 4A:
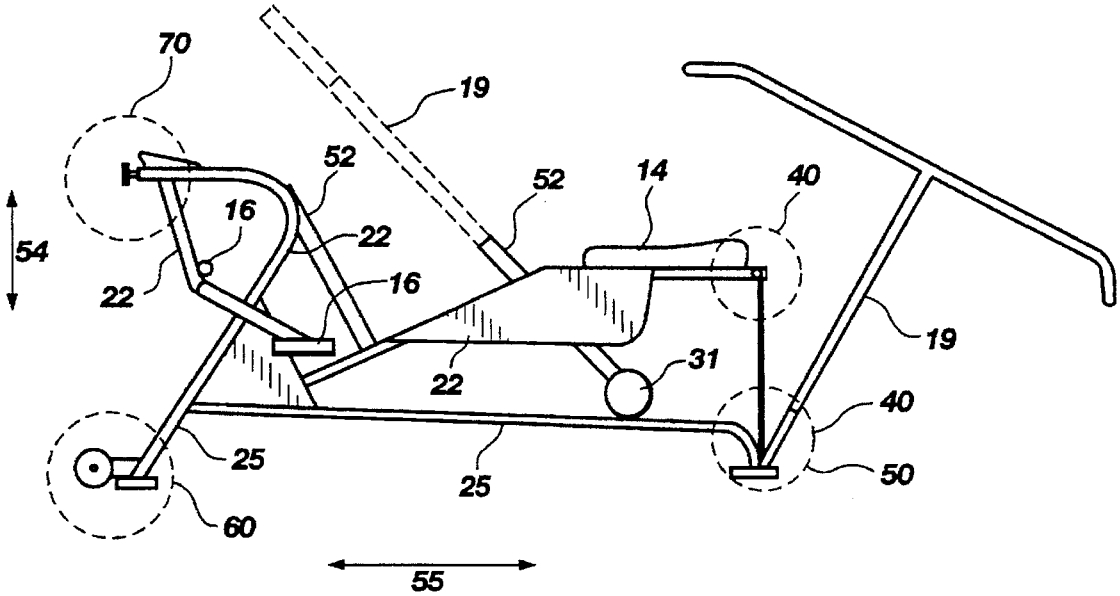
FIG. 4A is a profile view of the exercise apparatus of FIG. 1 modified in accordance with the principles of the present invention.

With this background in mind, FIG. 4A is a profile view of the exercise equipment 10 of FIG. 1 which has been modified in accordance with the principles of the present invention. In this preferred embodiment, the exercise equipment 10 has been modified in four ways which, when combined, enable the exercise equipment 10 to be tipped forward approximately 90 degrees from a typical, ready-to-use orientation. The four particular modifications to the structure of the exercise equipment are designated by circles 40, 50 60 and 70.

Figure 4B:
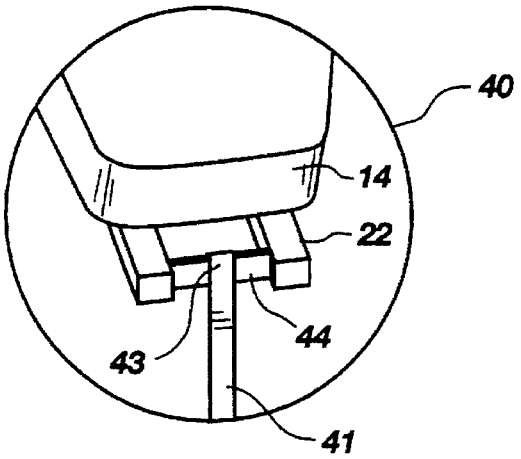
FIG. 4B is a perspective view of one modification made in accordance with the principles of the present invention.

FIG. 4B are enlarged perspective views of the modified area of circle 40. The exercise equipment has been modified with a restraint shown to be a strap 41. The strap 41 is fixed at one end 42 to the rear of the stationary base 25. The other end 43 of the strap 41 is selectively attachable to couple to the frame 22. The particular coupling mechanism can be any appropriate method, such as a hook placed on the strap and a corresponding protrusion or bar 44 on the frame 22 at the back of the seat 14. The strap 41 should be slightly flexible to enable it to be slightly stretched so that when secured to the frame 22, the strap 41 provides some tension against the frame 22 and the coupled seat 14 so that they cannot move. This restraint 41 is important to the present invention because the movable portion of the exercise equipment 10 is effectively and advantageously immobilized by the strap 41 when the equipment 10 is tipped forward. Without the restraint 41, the natural tendency of the machine 10 would be for the wheel 31 to roll toward the front of the equipment 10, causing the seat 14 to fall forward and possibly strike objects in its path. The resulting configuration would also substantially and disadvantageously increase the depth of the equipment 10 when tipped forward 90 degrees. Restraining the seat 14 and frame 22 movement maintains the desired low profile of the exercise equipment 10.

Figure 4D:
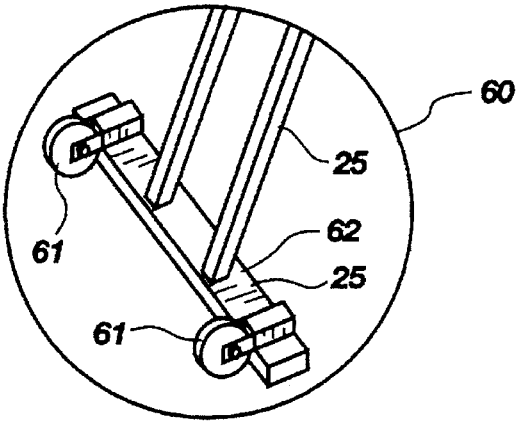
FIG. 4D is a perspective view of another modification made in accordance with the principles of the present invention.
Figure 4C:
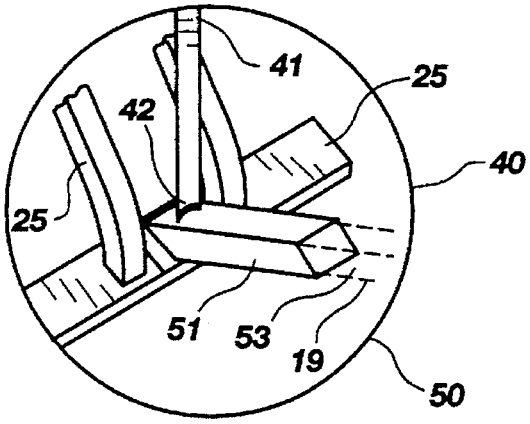
FIG. 4C is a perspective view of another modification made in accordance with the principles of the present invention.

FIG. 4C is an enlarged perspective view of the modified area of FIG. 4 designated by circle 50. The exercise equipment 10 has been modified with a new receptacle 51 for the handlebar 19. The handlebar 19 is detached from its original receptacle 52 (see FIG. 4A) and placed in the new receptacle 51 at an angle which generally aims a shaft 53 of the handlebar 19 parallel to the long axis 28 (see FIG. 1) of the equipment 10, but so as to point toward the rear. The shaft 53 of the handlebar 19 is also placed in the receptacle 51 such that the shaft is rotated 90 degrees in either direction relative to its typical in-use orientation (see FIG. 4A).

Some of the reasons for providing a new receptacle 51 for the handlebar are as follows. First, the new receptacle 51 is now advantageously at the rear of the exercise equipment 10. Placing the handlebar 19 at the rear provides a convenient grasping surface for the user when the equipment 10 is tipped forward. Second, moving the handlebar 19 advantageously reduces the height 54 (see FIG. 4A) of the equipment 10 by consequently increasing the overall length 55 (see FIG. 4A). By decreasing the height 54, the equipment 10 is now in a more suitable configuration for being tipped forward 90 degrees. Having decreased the height 54 thus enables the equipment 10 to be placed in a storage space having a shallower depth. Third, turning the handlebar 90 degrees makes the exercise equipment 10 narrower and advantageously easier to maneuver through narrower spaces such as closet doors.

FIG. 4D is a perspective view of the modified area of FIG. 4 designated by circle 60. The exercise equipment 10 has been modified with a pair of wheels 61 disposed on the front bar 62 which comprises a portion of the stationary base 25. As shown, the wheels 61 are disposed on either end of the front bar 62 such that the wheels 61 advantageously roll in a plane parallel to each other and the long axis 28 (see FIG. 1) of the equipment 10.

One of the important features of the position of the wheels 61 in the preferred embodiment is that when the exercise equipment 10 is in its typical ready-for-use position, the wheels 61 are not supporting the front end of the stationary base 25. If they were, the stability of the exercise equipment 10 would be jeopardized. The wheels 61 only support the equipment 10 when it is tipped forward for movement and storage.

Figure 4E:
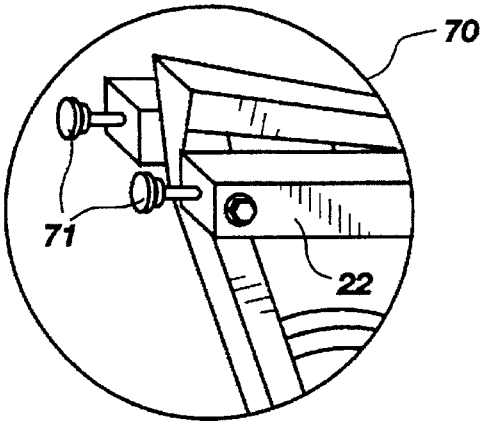
FIG. 4E is a perspective view of another modification made in accordance with the principles of the present invention.

FIG. 4E is an enlarged view of the modified area of FIG. 4A designated by circle 70. The exercise equipment 10 has been advantageously modified with feet 71 to provide support in combination with the wheels 61 (see FIG. 4D) when the equipment 10 is tipped forward about 90 degrees from its typical ready-for-use orientation. The feet 71 are placed on a portion of the frame 22 of the equipment 10. By making the length of the feet 71 selectively adjustable, the balance of the tipped-forward equipment 10 can be precisely modified so that the equipment 10 will be difficult to tip over.

Figure 5A:
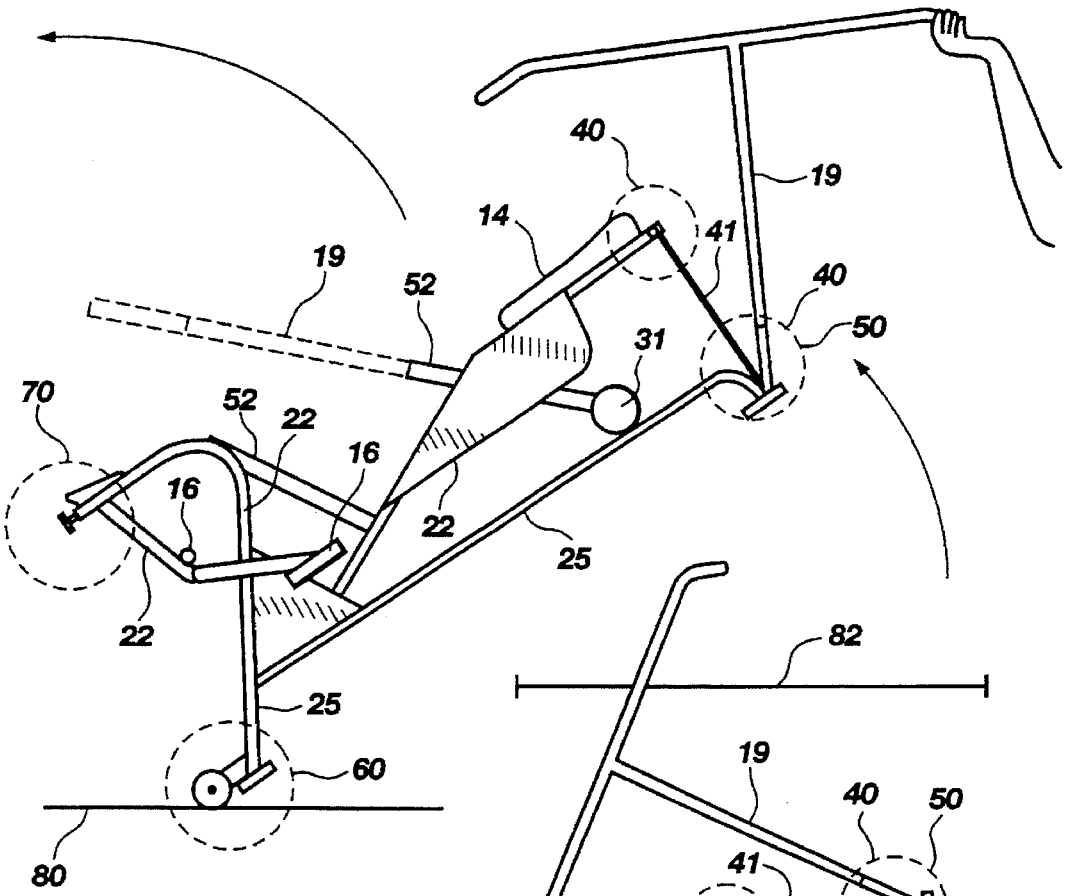
FIG. 5A is a view of the exercise equipment modified as in FIG. 4A, and being supported by the handlebar and tipped slightly forward.

FIG. 5A is a view of the exercise equipment 10 modified as in FIG. 4A, and being supported by the handlebar 19 and tipped slightly forward relative to the floor 80 so that the equipment 10 can be easily maneuvered to or from a storage site.

Figure 5B:
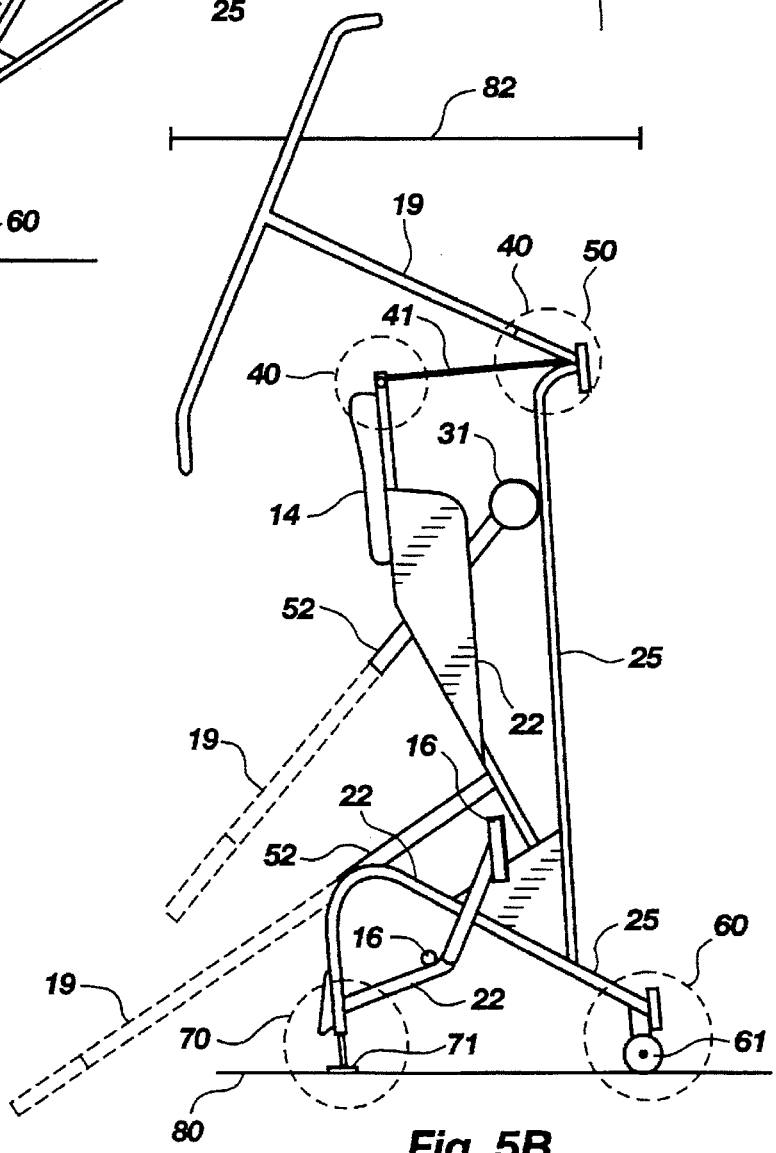
FIG. 5B is a view of the exercise equipment of FIG. 5A which is now tipped forward about 90 degrees from the typical ready-for-use orientation.

FIG. 5B is a view of the exercise equipment 10 of FIG. 5A which is now tipped forward about 90 degrees from the typical ready-for-use orientation. The equipment 10 now advantageously requires storage space with substantially less depth 82, and was maneuvered to the storage site with substantially less difficulty than is possible without the modifications of the present invention.

The seat 14 is prevented from falling forward by the restraining strap 41. The handlebar 19 is now in an orientation which is narrower and decreases the depth of the stored equipment 10. The wheels 61 now provide a support surface on the floor 80 in combination with the selectively adjustable length feet 71.

Figure 6:
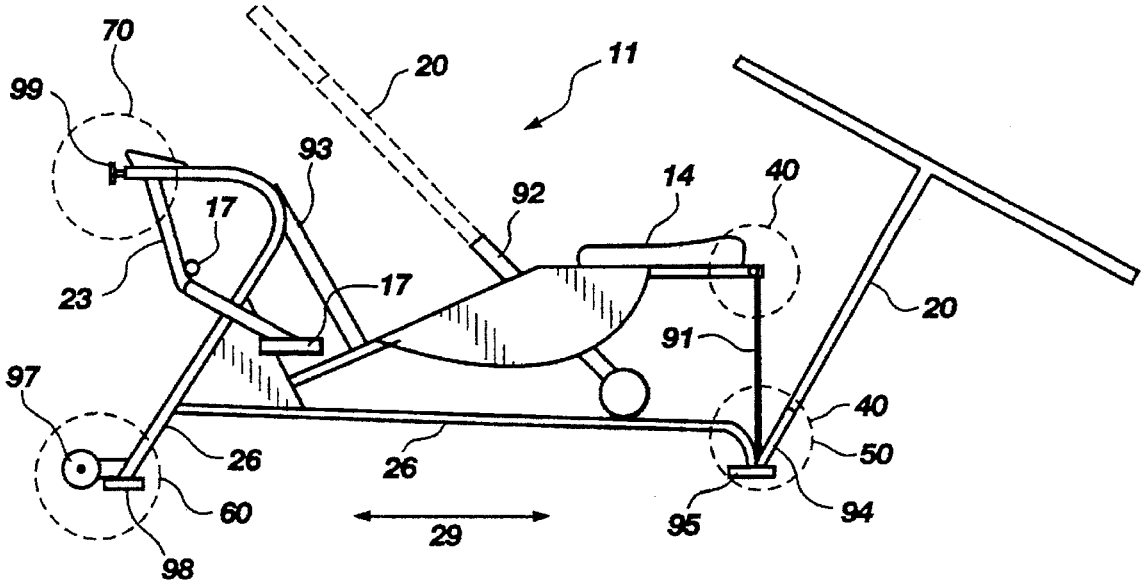
FIG. 6 is a profile view of the exercise apparatus of FIG. 2 with all the modifications made in accordance with the principles of the present invention.

While the preferred embodiment is designed for adaptation of HEALTHRIDER exercise equipment 10, the present invention is easily adaptable to work on other no-impact, repetitive motion exercise machines. For example, the exercise equipment 11 shown in FIG. 2 is shown with the advantageous modifications of the present invention in FIG. 6. The seat 14 is restrained by a strap 91. The handlebar 20 is removed from either of its old receptacles 92 or 93 and placed in a new rearward projecting receptacle 94 on the rear support bar 95 of the stationary base 26. Two wheels 97 are placed towards either end of the front support bar 98 in parallel with each other and the long axis 29 of the equipment 11, but not in contact with the floor when the equipment 11 is in a ready-for-use orientation. And last, at least one selectively adjustable supporting foot 99 is placed on the supporting frame 23 to provide a supporting surface in combination with the wheels 97.

Figure 7:
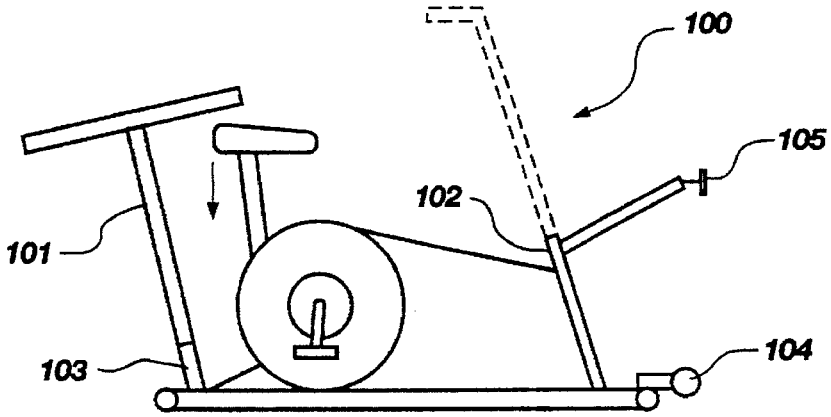
FIG. 7 is a profile view of an exercise bike with all the modifications made in accordance with the principles of the present invention.
Figure 8:
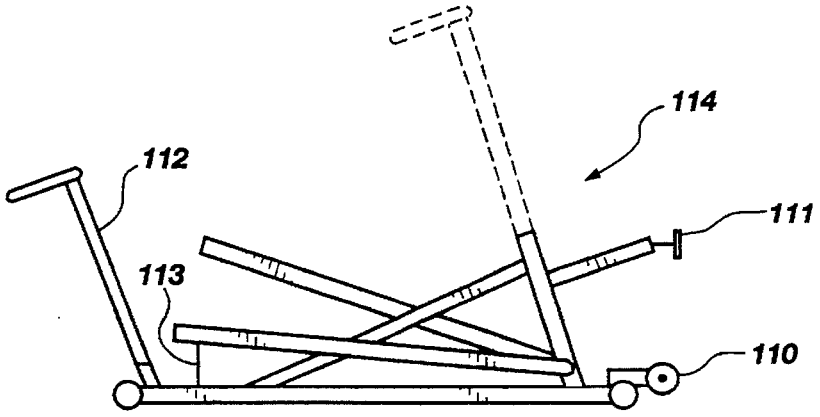
FIG. 8 is a profile view of a stair stepper with all the modifications made in accordance with the principles of the present invention.

FIGS. 7 and 8 are provided to demonstrate the concept that the principles of the present invention are adaptable to other types of no-impact, repetitive motion exercise machines. FIG. 7 illustrates how an exercise bike 100 is tipped forward about 90 degrees so that it can also be stored in a more convenient orientation requiring less depth at a storage site than would be otherwise required. For example, the handlebar 101 is removed from its original receptacle 102 and placed in a new receptacle 103. The bike 100 is then tipped forward onto wheels 104 for maneuvering to and from storage, and tipped forward about 90 degrees onto the wheels 104 and at least one foot 105 for more convenient storage.

Likewise, FIG. 8 is provided to show how a stair stepper can also be modified. The elements of wheels 110, a support foot 111, a removable handlebar 112, and straps 113 for preventing movement of the movable components of the repetitive motion exercise equipment 114.

Figure 9:
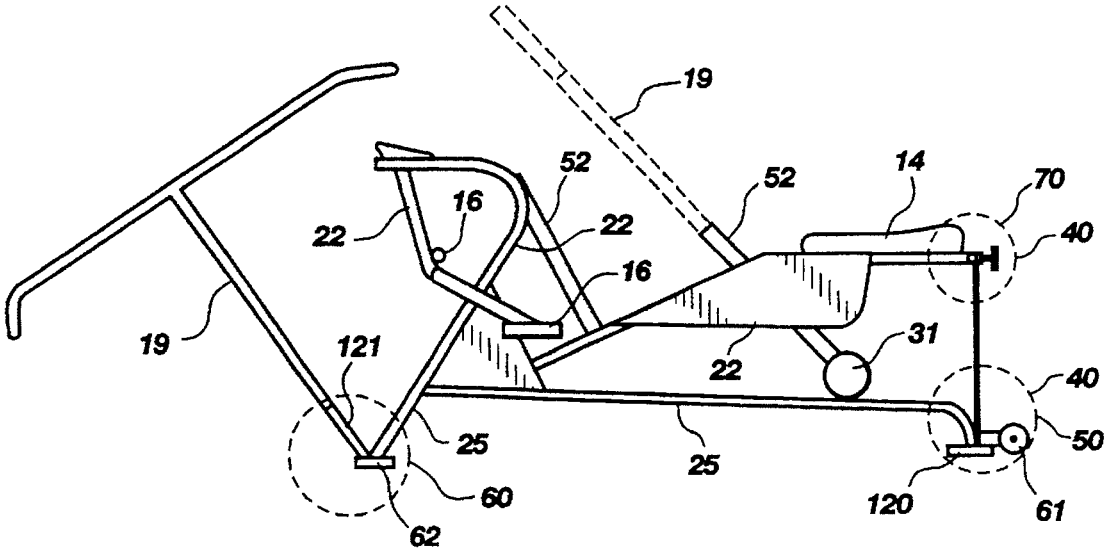
FIG. 9 is a profile view of the exercise apparatus of the preferred embodiment, but modified to be in a tipped-rearward orientation.

The embodiments of the present invention are all shown having a tipped forward orientation. It should be noted that the modifications can also be adapted to a tipped rearward orientation. FIG. 9 provides an illustration of the HEALTHRIDER of FIGS. 4 and 5 which has been thus altered to present this alternate embodiment. The changes are that the wheels 61 are now advantageously placed on the rear support bar 120 of the stationary base 25 and the new handlebar receptacle 121 is consequently placed on the front support bar of the equipment 10.

It is to be understood that the above-described embodiments are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. An aerobic exercise apparatus for providing no-impact, repetitive motion exercise, said aerobic exercise apparatus having a long axis, wherein a set of components includes a seat disposed on a support frame and being parallel to the long axis and pivotally coupled at a first pivot on the support frame to a stationary base, a foot brace generally perpendicular to the long axis and coupled to the support frame at a second pivot, and a handlebar having a handlebar member generally perpendicular to the long axis, a handlebar support member being generally perpendicular to the handlebar member and attached at a first end to the handlebar member, coupled at a second end to a wheel which is rollingly disposed on the stationary base, and wherein the handlebar support member is coupled between the first end and the second end at a third pivot to the support frame, the support frame being parallel to the long axis for supporting the set of components in a manner which enables a limited range of repetitive motion of the set of components, and the stationary base having at least one support coupled thereto which is perpendicular to the long axis but generally parallel to a floor for supporting the support frame and the set of components;

means for restraining the aerobic exercising apparatus so as to immobilize the set of components, the frame end the stationary base relative to each other;

means for enabling the aerobic exercise apparatus to be moved as an immobilized unit; and means for stabilizing the aerobic exercise apparatus in a tipped forward or rearward upright position perpendicular to the long axis, and being suitable for storage.

2. The aerobic exercise apparatus of claim 1 wherein a portion of the handlebar support member which includes the handlebar member of the set of components is detachable from the aerobic exercise apparatus.

3. The aerobic exercise apparatus of claim 2 wherein the stationary base further comprises a receptacle for receiving and immobilizing the portion of the handlebar support member such that the handlebar member is oriented along the long axis of the aerobic exercise apparatus, and the handlebar support member is generally oriented at 90 degrees relative to an in-use orientation.

4. The aerobic exercise apparatus of claim 1 wherein the means for restraining the aerobic exercising apparatus so as to immobilize the set of components comprises a strap coupled between the stationary base and the set of components.

5. The aerobic exercise apparatus of claim 4 wherein the strap is anchored at a fixed end to the stationary base, and the set of components includes a means for attaching the strap at an attaching end to the set of components.

6. The aerobic exercise apparatus of claim 5 wherein the means for attaching the strap at an attaching end comprises a hook, and the set of components further comprises a bar generally perpendicular to the long axis and coupled to the support frame of the apparatus over which the hook is placed.

7. The aerobic exercise apparatus of claim 4 wherein the strap is flexible and is stretched taut when in a securing position to provide a secure restraint for the set of components.

8. The aerobic exercise apparatus of claim 1 wherein the means for moving the aerobic exercise apparatus as an immobilized unit comprises at least two wheels coupled to the stationary base at the at least one support and oriented such that the at least two wheels roll in a plane parallel to each other and the long axis of the apparatus when supporting the apparatus.

9. The aerobic exercise apparatus as defined in claim 8 wherein the stationary base further comprises:

a front support bar and rear support bar, both generally parallel to the floor and generally perpendicular to the long axis of the apparatus; and means for coupling the front bar and the rear bar to the stationary base.

10. The aerobic exercise apparatus of claim 9 wherein the at least two wheels are coupled to the front support bar such that when the apparatus is in use, the at least two wheels are disposed so as not to be in contact with the floor, thereby preventing inadvertent movement of the apparatus during use.

11. The aerobic exercise apparatus of claim 9 wherein the at least two wheels are coupled to the rear support bar such that when the apparatus is in use, the at least two wheels are raised so as not to be in contact with the floor, thereby preventing inadvertent movement of the apparatus.

12. The aerobic exercise apparatus of claim 11 wherein the means for stabilizing the aerobic exercise apparatus in a compact position suitable for storage comprises at least one support foot coupled to the set of components such that the apparatus is balanced on the at least one support foot and the at least two wheels when the apparatus is raised to an upright position.

13. The aerobic exercise apparatus of claim 1 wherein the means for stabilizing the aerobic exercise apparatus in a position suitable for storage comprises at least one support foot coupled to the support frame such that the apparatus is balanced on the at least one support foot and the at least two wheels when the apparatus is tipped forward to an upright position.

14. The aerobic exercise apparatus of claims 12 or 13 wherein the at least one support foot includes means for selectively modifying a length of the foot away from the set of components such that the balance of the apparatus can be adjusted.

15. The aerobic exercise apparatus of claim 14 wherein the at least one support foot is specifically comprised of two support feet, each disposed on a front end of the support frame such that the two support feet touch the floor simultaneously when the apparatus is tipped forward or backward generally 90 degrees relative to an in-use orientation.

16. An aerobic exercise apparatus for providing no-impact, repetitive motion exercise, said aerobic exercise apparatus having a long axis, wherein a set of components includes a seat disposed on a support frame and being parallel to the long axis and pivotally coupled at a first pivot on the support frame to a stationary base, a foot brace generally perpendicular to the long axis and coupled to the support frame at a second pivot, and a handlebar having a handlebar member generally perpendicular to the long axis, a handlebar support member being generally perpendicular to the handlebar member and attached at a first end to the handlebar member, coupled at a second end to a wheel which is rollingly disposed on the stationary base, and wherein the handlebar support member is coupled between the first end and the second end at a third pivot to the support frame, the support frame being parallel to the long axis for supporting the set of components in a manner which enables a limited range of repetitive motion of the set of components, and the stationary base having at least one support member coupled thereto and which is perpendicular to the long axis but generally parallel to a floor to thereby support the support frame and the set of components;

a restraining strap coupled between the stationary base and the set of components;

at least two wheels disposed on the at least one support member such that the wheels roll in a plane parallel to each other and the long axis of the aerobic exercise apparatus;

at least one supporting foot coupled to the apparatus at a forward end of the support frame such that the aerobic exercise apparatus is balanced on the at least one support foot and the at least two wheels; and a detachable handlebar support member which is generally turned 90 degrees from an in-use orientation and mounted in a receptacle disposed on the rear support bar.

* * * * *